US011322831B1

(12) United States Patent
Rmili et al.

(10) Patent No.: US 11,322,831 B1
(45) Date of Patent: May 3, 2022

(54) RADIO CROSS-SECTION REDUCTION OF CONFORMAL ANTENNAS MOUNTED ON VEHICLES

(71) Applicant: King Abdulaziz University, Jeddah (SA)

(72) Inventors: Hatem Malek Rmili, Jeddah (SA); Raj Mittra, Jeddah (SA); Asim Ghalib, Jeddah (SA); Majed Nour, Jeddah (SA)

(73) Assignee: King Abdulaziz University, Jeddah (SA)

( * ) Notice: Subject to any disclaimer, the term of this patent is extended or adjusted under 35 U.S.C. 154(b) by 0 days.

(21) Appl. No.: 17/363,373

(22) Filed: Jun. 30, 2021

(51) Int. Cl.
*H01Q 1/32* (2006.01)
*H01Q 1/42* (2006.01)
*H01Q 1/38* (2006.01)

(52) U.S. Cl.
CPC ..... *H01Q 1/421* (2013.01); *H01Q 1/32* (2013.01); *H01Q 1/38* (2013.01)

(58) Field of Classification Search
CPC ..... H01Q 1/421; H01Q 1/32; H01Q 1/38; H01Q 15/0013; H01Q 15/0026; H01Q 19/10; H01Q 15/0086; H01Q 17/00; H01Q 21/065; H01Q 9/0407
See application file for complete search history.

(56) References Cited

U.S. PATENT DOCUMENTS

2016/0011782 A1 1/2016 Kurotsuchi et al.
2019/0305436 A1* 10/2019 Legay ..... H01Q 5/28
2021/0249787 A1* 8/2021 Schuss ..... H01Q 1/521

FOREIGN PATENT DOCUMENTS

CN 104934715 A1 9/2015
CN 109713457 A1 5/2019
CN 111430903 A1 7/2020

OTHER PUBLICATIONS

M Joozdhani, "Radar Cross Section Reduction of Conformal Patch Antenna Using Mantle Cloak", 27th Iranian Conference on Electrical Engineering (ICEE2019).
L Zhou, "Hybrid Frequency-Selective Rasorber with Low-Frequency Diffusion and High-Frequency Absorption", IEEE, Aug. 27, 2020.

* cited by examiner

*Primary Examiner* — David E Lotter
(74) *Attorney, Agent, or Firm* — WCF IP

(57) ABSTRACT

The radar cross section (RCS) of a vehicle/antenna combination is reduced by using an antenna and ground plane which are of substantially the same area, and using a frequency selective surface (FSS) in the regions on the periphery of the ground plain where the FSS is designed to be transparent and thereby pass out-of-band frequencies, while reflecting one or more operating frequencies of the antenna. A multilayer absorber below the FSS absorbs the out-of-band frequencies that a larger ground plane may have otherwise reflected to the body of the vehicle to which the antenna is mounted.

10 Claims, 3 Drawing Sheets

RADIO CROSS-SECTION REDUCTION OF CONFORMAL ANTENNAS MOUNTED ON VEHICLES

FIELD OF THE INVENTION

Antennas are used in a wide variety of applications to guide vehicles, such as drones, missiles, planes and other aircraft, or track (e.g., tanks) other wheeled vehicles, from one point to another. Radiofrequency transmissions from the antenna as well as the vehicle on which it is mounted can be detected by third parties not intended to possess this information. This invention pertains to a configuration of the vehicle with one or more antennas thereon (radiating elements) where the detectable radio cross-section of the vehicle is reduced.

BACKGROUND

In military applications, there is a desire to produce vehicles which are difficult to detect using radars. This is accomplished by configuring the vehicle in a shape that is less detectable, or by covering the surface of the vehicle with radar absorbing materials. However, antennas are often used to guide military vehicles for homing, sensing, and communications, and the antennas themselves cannot be covered with radar absorbing materials without adversely affecting the performance of the antenna. When an antenna is used on a military vehicle such as a missile or drone, it is desirable to reduce the radar cross-section (RCS) of the vehicle/antenna combination as much as possible.

A common approach to reducing RCS is to modify the ground plane using a metasurface which either absorbs or diffuses incoming radiation so as to reduce the RCS. For example, Zhou-IEEE (Aug. 27, 2020) describes the configuration of a frequency selective rasorber (FSR) for low frequency diffusion and high frequency absorption where a metasurface is used to cover the ground plane of the antenna, and Joozdani-ICEE 2019 describes a mantle cloak for an antenna where a metasurface covers the ground plane of the antenna.

SUMMARY

In an application where an antenna is on a vehicle such as an aircraft (e.g., drone, plane, missile, etc.) or other vehicles (e.g., ship, tank or other track vehicle, or a wheeled vehicle), the antenna is mounted to the vehicle, and the vehicle itself is a major contributor to the RCS of the vehicle/antenna combination. With this insight, embodiments of the invention employ a ground plane of reduced size surrounded be a frequency selective surface (FSS) that is transparent at out-of-band frequencies and reflective at one or more operating frequencies of the antenna (radiating element).

The contribution to the RCS of from the ground plane can be significantly reduced by reducing the size of the ground plane, and this can be done without affecting the performance of the antenna, even when the ground plane is approximately the same size or only slightly larger than the footprint of the antenna. The body of the vehicle, which is not used in communications, homing or sensing, will produce less undesirable vibrations radiations because it does not receive reflections from the ground plane, which is of reduced size, and because the area surrounding the smaller ground plane incorporates an FSS which permits out-of-band frequencies to be passed to an absorber where they are absorbed and reflection is reduced or eliminated. However, the FSS is designed to reflect the one or more operating frequencies of the antenna, thus, the FSS can enhance the transmissions from the antenna which are desired, while effectively allowing the undesirable transmissions to be absorbed. The net effect of the invention is to significantly reduce the RCS of the combined vehicle/antenna combination.

DESCRIPTION OF THE DRAWINGS

FIG. 2*a* is a view of the top and bottom layers of the FSS, FIG. 2*b* is a view of the middle layer of the FSS, FIG. 2*c* is an isometric view of the three layer stack making the FSS, and FIG. 2*d* is a side view of the FSS stack.

DETAILED DESCRIPTION

Figure 1:
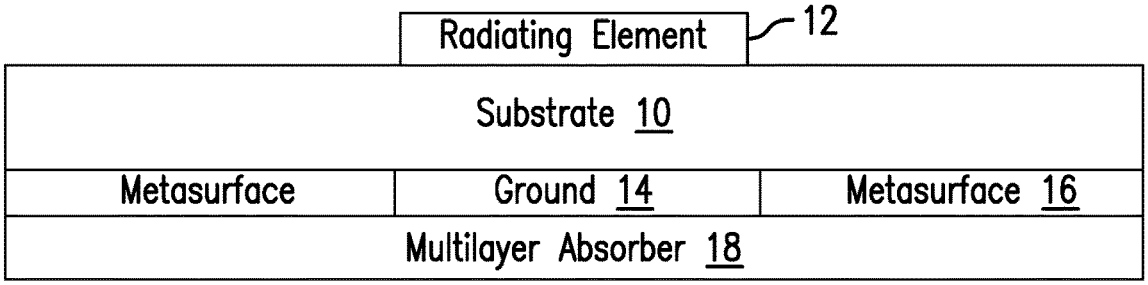
FIG. 1 is a cross-sectional view of a low-RCS antenna.

FIG. 1 illustrates the cross-section of a low-RCS antenna on a vehicle according to the invention. The vehicle could be an aircraft such as a drone, missile, plane, helicopter, etc., and it may also be other types of moveable objects such as track vehicles (tanks), wheeled vehicles (cars and jeeps), ships, space ships, etc. The vehicle will have surface, designated as substrate 10, onto which a radiating element 12 will be mounted. The radiating element 12 can be a single antenna or an array of antennas. One or more radiating elements 12 can be positioned on the substrate 10 at different locations (e.g., the fore and aft of a missile, etc.).

In order to be operational, the radiating element 12 must be connected to a ground 14. In order better conform to the shape of the substrate, as well as to reduce the impact of the ground 14 on RCS, the ground 14 is made be approximately the same size, in terms of its foot print in the x and y dimensions as the radiating element 12. This can be done without adversely impacting the performance of the radiating element 12 (antenna). As will be discussed below, the area defined by the x and y dimensions of the ground 14 are the same size or slightly larger (e.g., within 5%) of the x and y dimensions of the radiating element 12. Thus, the ground 14, being smaller in size than it is in prior applications, contributes very little to the RCS and only reflects transmissions which are directed straight through the substrate 10 from the radiating element 12.

On the outer periphery of the ground 14, is one or more frequency selective surfaces (FSS). Having the FSS 16 have approximately the same thickness as the ground 14 enhances the conformal nature of the present design, as it will fit curve shapes, etc. of the substrate 10. The FSS 16 may sometimes be referred to as a metasurface. The FSS 16 will be designed to reflect only the one or more operating frequencies of the antenna or antennas in array on the radiating element 12, and will be designed to permit out-of-band frequencies to be passed to an absorber 18 where they are absorbed and reflection is reduced or eliminated. The absorber is preferably a multilayer absorber made from the commercial material "ECCOSORB" (a polyurethane foam material for RF absorption, examples of which are available from Laird Technologies of Cleveland Ohio).

In operation, transmissions from the radiating element 12 are reflected by the FSS 16, but vibrations and other transmissions generated by the radiating element and the vehicle 10 to which it is attached which are not intended to be transmitted, are passed by the FSS 16 to the multilayer absorber 18 and are either reduced or eliminated such that the vehicle/antenna combination has a much lower RCS than if the ground plane 14 was not reduced in size and no FSS 16 was provided. Having the radiating element 12 on opposite sides of the vehicle substrate 10 from the ground 14 and FSS 16 and absorber 18, allows for the radiating element 12 to have no or only limited impact on the aerodynamics of the vehicle.

Figure 2A:
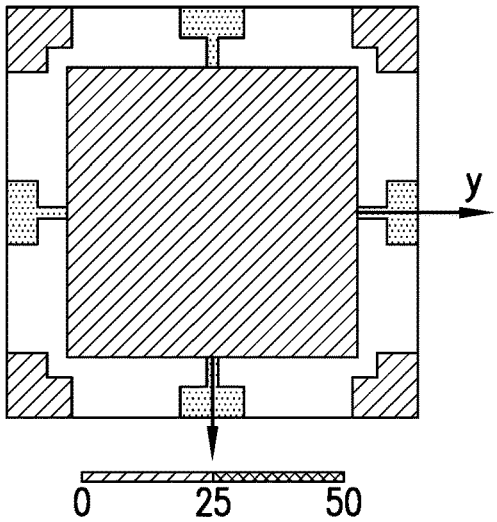
FIGS. 2*a-d* are views of an exemplary FSS which may be positioned about the periphery of the ground plane in a low-RCS antenna, where
Figure 2B:
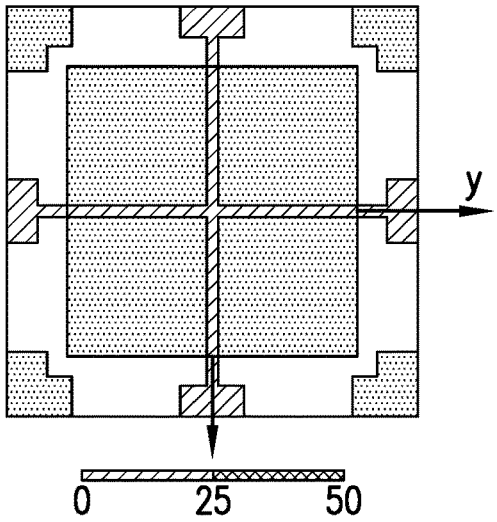
Figure 2C:
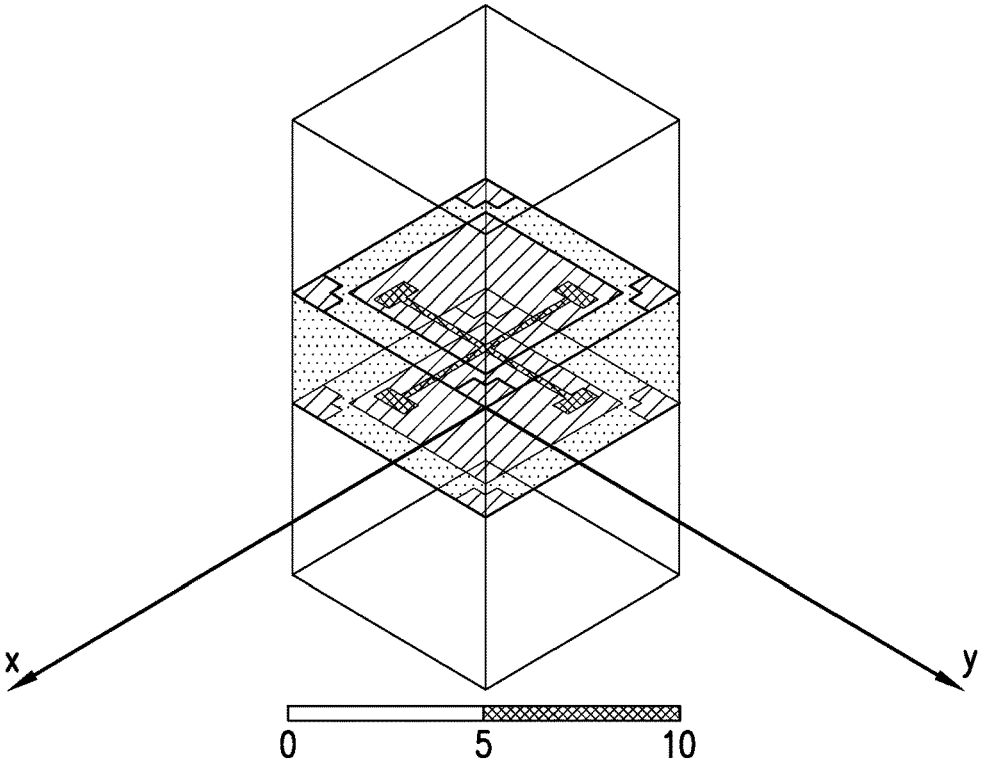
Figure 2D:
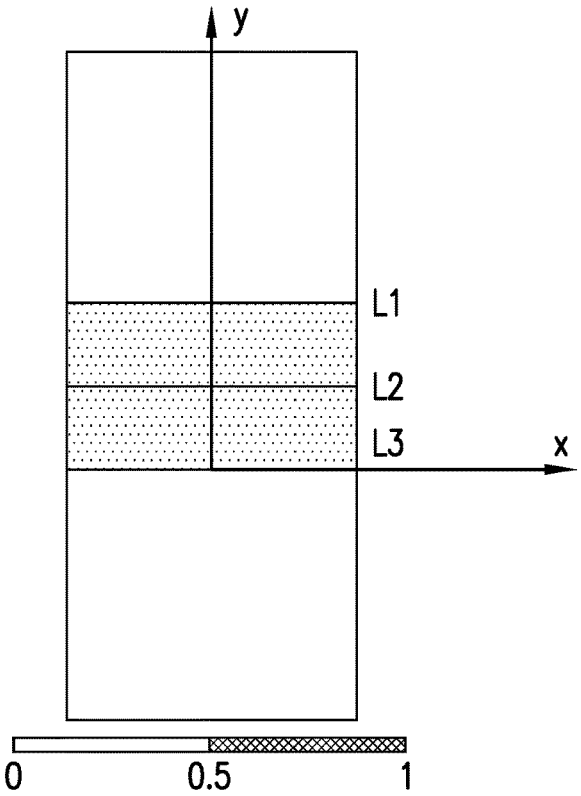

The construction of the FSS 16 can take a variety of forms and is dependent on the transmissions to be passed and the operating transmissions to be reflected. FIGS. 2*a*-2*d* show an exemplary three-dimensional (3D) design of an FSS 16 according to one embodiment of the invention. For example, the FSS can have three layers as shown in FIG. 2*d*. The top and bottom layers L1 and L3, respectively, can, as is shown in FIG. 2*a* have a metallic square with metallic corner offsets. The middle layer L2 may have metallization in a cross shape as is shown in FIG. 2*b*. FIG. 2*a* shows the ends of the cross shape in relief, and FIG. 2*b* shows the central square and offset corners in relief, as the would appear from the top when the layers are stacked. FIG. 2*c* shows an example of the three layer structure from an isometric view. The metallization on each of the three layers L1-3, can be present on a low loss material such as the commercial material "ECCOSORB" from Laird Technologies as a polyurethane foam RF absorbing material, and the entire lay up may have a thickness of 2 mm (1 mm for each layer). The multilayer absorber is designed to provide approximately −10 dB reflection coefficient over the desired frequency band.

Figure 3:
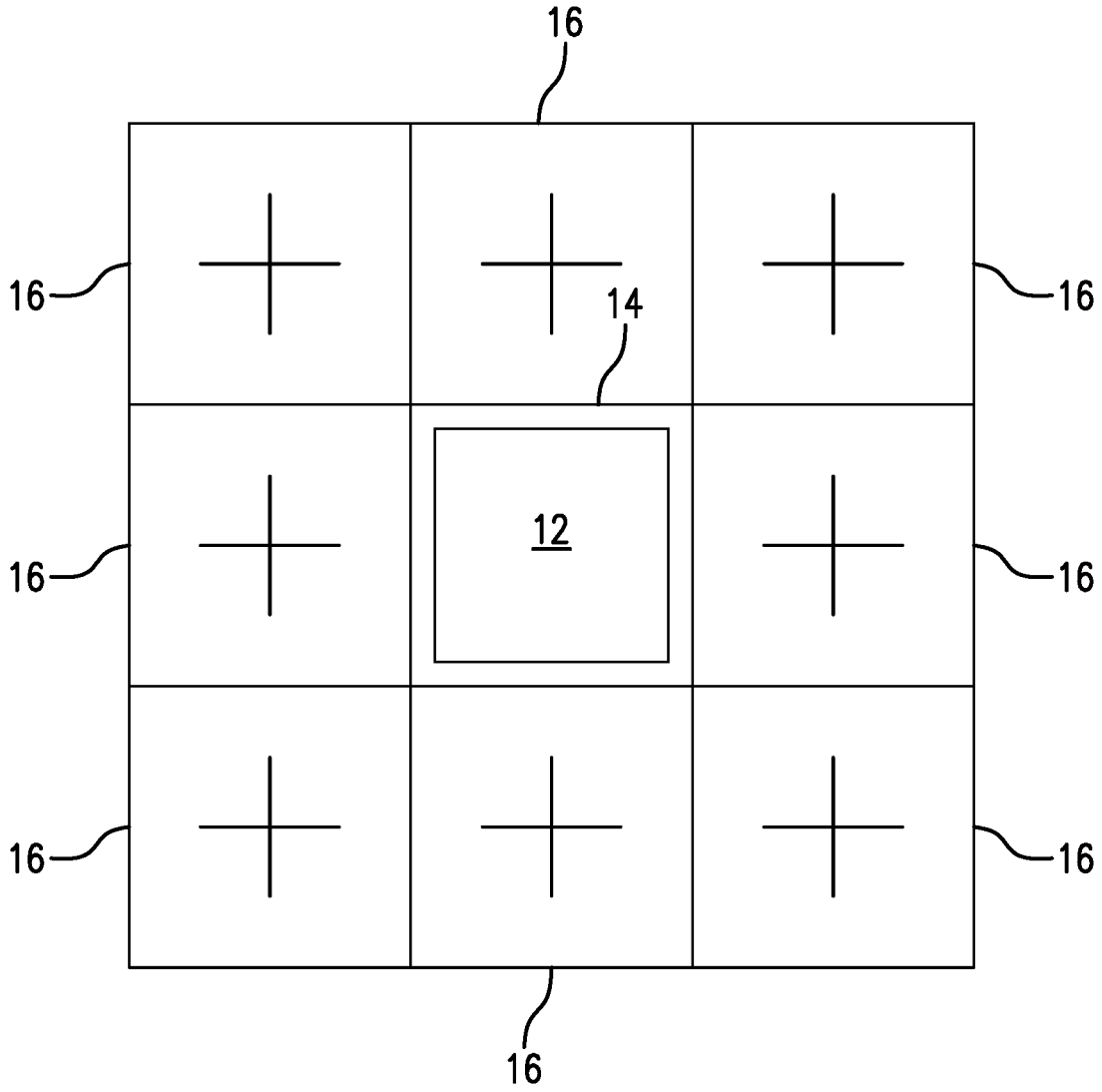
FIG. 3 is a plan view showing the relative dimensions of the antenna and the ground plane, with FSS material surrounding the periphery of the ground plane.

FIG. 3 shows a plan view where the radiating element is only slightly smaller than the ground plane 14 in terms of area (x and y dimensions) (e.g., the ground plane 14 is the same size or only up to 5% larger than the radiating element 12). Surrounding the periphery of the ground plane 14 are a series of 3D FSS 16 elements as described in conjunction with FIGS. 2*a*-*d*. However, the FSS 16 can take other forms. The primary function of the FSS is to pass the out-of-bounds frequencies while being able to reflect one or more of the operating frequencies of the radiating element.

The invention claimed is:

1. A vehicle with at least one antenna having reduced radio cross-section characteristics, comprising:

at least one radiating element mounted on one side of a surface of the vehicle;

a ground plane mounted on an opposite side of the surface of the vehicle and in alignment with the at least one radiating element in a z dimension, wherein the ground plane and the at least one radiating element have approximately a same x and y dimensions;

a frequency selective surface positioned adjacent an outer periphery of the ground plane on the opposite side of the surface of the vehicle, the frequency selective surface being substantially transparent at out-of-band frequencies of the at least one radiating element and being reflecting at one or more operating frequencies of the at least one radiating element; and a multilayer absorber positioned over the frequency selective surface and the ground plane and spaced away from the opposite side surface of the vehicle in the z dimension by a thickness of the ground plane and the frequency selective surface.

2. The vehicle of claim 1 wherein the vehicle is an aircraft.

3. The vehicle of claim 2 wherein the aircraft is a missile.

4. The vehicle of claim 2 wherein the aircraft is a drone.

5. The vehicle of claim 2 wherein the aircraft is a plane.

6. The vehicle of claim 1 wherein the vehicle is a track or wheeled vehicle.

7. The vehicle of claim 1 wherein the at least one radiating element is a single antenna.

8. The vehicle of claim 1 wherein the at least one radiating element is an array of antennas.

9. The vehicle of claim 1 wherein the x and y dimensions of the ground plane are within 5% of the x and y dimensions of the at least one radiating element.

10. The vehicle of claim 1 wherein the multilayer absorber is a polyurethane foam designed to provide approximately −10 dB reflection coefficient over a desired frequency band.

* * * * *